US009609957B1

(12) United States Patent
Todd

(10) Patent No.: US 9,609,957 B1
(45) Date of Patent: Apr. 4, 2017

(54) PORTABLE FOLDABLE BED

(71) Applicant: David D. Todd, Springtown, TX (US)

(72) Inventor: David D. Todd, Springtown, TX (US)

( * ) Notice: Subject to any disclaimer, the term of this patent is extended or adjusted under 35 U.S.C. 154(b) by 0 days.

(21) Appl. No.: 15/272,543

(22) Filed: Sep. 22, 2016

Related U.S. Application Data

(60) Provisional application No. 62/221,731, filed on Sep. 22, 2015.

(51) Int. Cl.
*A47C 27/08* (2006.01)

(52) U.S. Cl.
CPC ..... *A47C 27/081* (2013.01); *A47C 27/08* (2013.01)

(58) Field of Classification Search
CPC ..... A47C 27/08; A47C 27/081; A47C 27/084; A47G 9/1027; A61G 7/05769
USPC ..... 5/706, 644, 654, 655.3
See application file for complete search history.

(56) References Cited

U.S. PATENT DOCUMENTS

| | | | | | |
|---|---|---|---|---|---|
| 2,434,641 | A * | 1/1948 | Burns | A47C 27/081 | 114/219 |
| 3,298,044 | A * | 1/1967 | Saltness | A47C 27/081 | 5/644 |
| 5,068,933 | A * | 12/1991 | Sexton | A47G 9/1027 | 5/644 |
| 6,546,579 | B1 * | 4/2003 | Leventhal | A47C 27/081 | 297/452.41 |
| 7,127,759 | B2 * | 10/2006 | Koops | A47G 9/10 | 5/636 |
| 2005/0172409 | A1 * | 8/2005 | Koops | A47G 9/10 | 5/636 |

* cited by examiner

*Primary Examiner* — Robert G Santos
(74) *Attorney, Agent, or Firm* — Eldrege Law Firm; Richard G. Eldredge

(57) ABSTRACT

A bed system includes a semi-rigid top foam member having a top periphery edge; a semi-rigid bottom foam member having a bottom periphery edge; a first spring extending through the top periphery edge; a second spring extending through the bottom periphery edge; a foldable pliable material rigidly attached to the top periphery edge and rigidly attached to the bottom periphery edge; a sealed cavity formed by the top foam member, the bottom foam member, and the foldable pliable material; and a valve secured to and extending through a thickness of the foldable pliable material and in gaseous communication with the sealed cavity.

1 Claim, 2 Drawing Sheets

PORTABLE FOLDABLE BED

BACKGROUND

1. Field of the Invention

The present invention relates generally to portable beds, and more specifically, to a portable bed that can be folded.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
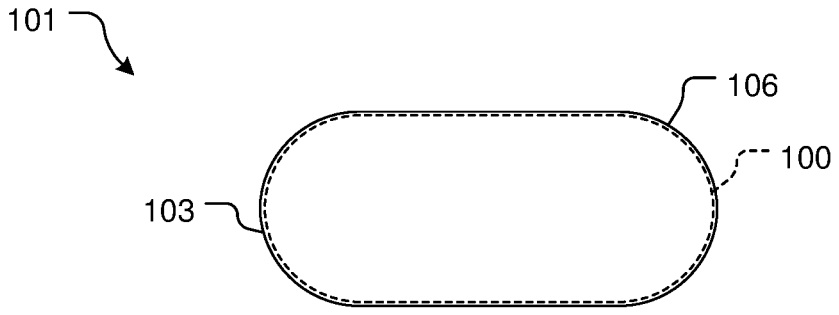
FIG. 1 is a top unfolded view of a bed system and method in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-5 depict various embodiments of the bed system 101 and method of use in accordance with a preferred embodiment of the present application. It will be appreciated that the bed system 101 overcomes one of more of the above-listed problems commonly associated with conventional beds, including portable beds such as air mattresses. Specifically, the bed system 101 is lightweight and easy to transport.

Figure 2:
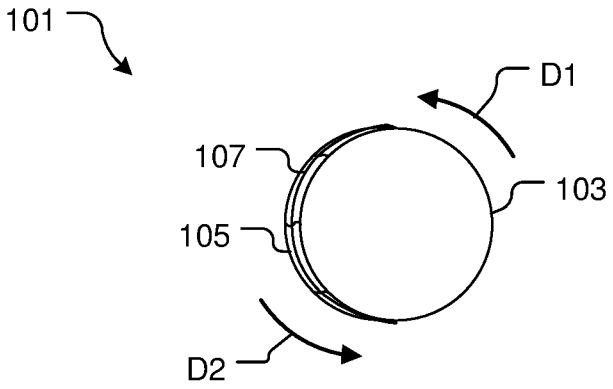
FIG. 2 is a top folded view of the bed system of FIG. 1.

Bed system 101 includes a semi-rigid top foam member 103, a semi-rigid bottom foam member 105, and a pliable foldable material 107 rigidly attached around the periphery edges of the top foam member 103 and the bottom foam member 105 and disposed therebetween. Both top member 103 and bottom member 105 are preferably composed of a material that is spring loaded, thereby having a spring around the periphery edge and configured to retain the members in the depicted shape while unfolded and in a cylindrical shape when folded, as depicted in FIG. 2. Accordingly, forces in directions D1 and D2 will cause the members 103, 105 to fold in the cylindrical position, ready for storage and/or transport.

Figure 3:
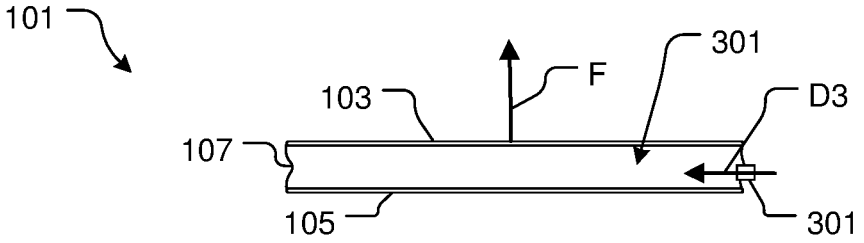
FIGS. 3, 4, and 5 are side views of the bed system of FIG. 1.
Figure 4:
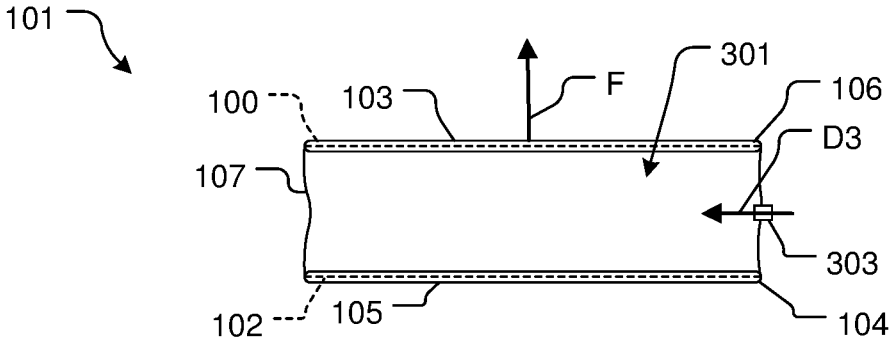
Figure 5:
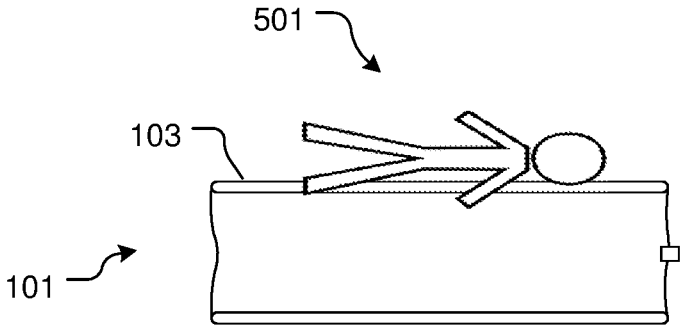

In the preferred embodiment, the foldable material 107 is rigidly attached to the edges of members 103, 105 and is adapted to form a fluidly sealed cavity 301 between members 103, 105, and material 107, as depicted in FIGS. 3-5.

System 101 is further provided with a valve 303 secured to material 107 and configured to channel fluid to the cavity 301, as depicted with an arrow D3, when a force is applied to member 103, as depicted with arrow F. During assembly, the user will pull against member 103, which in turn will suck the air within the air assembly and retain the air therein by valve 301. Thereafter, a person 501 is able to rest on the surface of member 103. The valve is opened after use and the system is folded for transport and/or storage.

As shown in FIG. 4, a first spring 100 is disposed within the periphery edge 106 of the top member 103, while a second spring 102 is disposed within a periphery edge 104 of the bottom member 105. The springs are utilized to assist the user fold the top member and the bottom members in a circular shape, as depicted in FIG. 2.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description.

Although the present embodiments are shown above, they are not limited to just these embodiments, but are amenable to various changes and modifications without departing from the spirit thereof.

What is claimed is:

1. A bed system, comprising:

a semi-rigid top foam member having a top periphery edge;

a semi-rigid bottom foam member having a bottom periphery edge;

a first spring extending within the top periphery edge;

a second spring extending within the bottom periphery edge;

a foldable pliable material rigidly attached to the top periphery edge and rigidly attached to the bottom periphery edge;

a sealed cavity formed by the top foam member, the bottom foam member, and the foldable pliable material; and a valve secured to and extending through a thickness of the foldable pliable material and in gaseous communication with the sealed cavity;

wherein opposing forces applied against the top foam member and the bottom foam member directs gas through the valve and into the sealed cavity; and wherein the valve is closed to trap the gas within the sealed cavity such that top foam member and the bottom foam member are kept at a fixed distance relative to each other.

* * * * *